United States Patent [19]

Wilkinson

[11] 3,944,386

[45] Mar. 16, 1976

[54] PROCESS FOR DYEING FILAMENTS OF ACRYLIC POLYMER

[75] Inventor: William Kenneth Wilkinson, Waynesboro, Va.

[73] Assignee: E. I. Du Pont de Nemours and Company, Wilmington, Del.

[22] Filed: Nov. 12, 1973

[21] Appl. No.: 415,248

[52] U.S. Cl. ..... 8/177 R; 8/17; 8/177 AB; 8/177 C; 264/78

[51] Int. Cl.[2] ..... D06P 3/70

[58] Field of Search..... 8/177 R, 177 AB, 177 C, 8/17; 264/78

[56] References Cited

UNITED STATES PATENTS

| | | | |
|---|---|---|---|
| 2,774,648 | 12/1956 | Mecco et al. | 8/177 R |
| 3,111,357 | 11/1963 | Wirth et al. | 264/78 |

*Primary Examiner*—M. J. Welsh

[57] ABSTRACT

A process is disclosed for dyeing a bundle of dry-spun acrylonitrile polymer filaments before the solvent remaining after the spinning step has been extracted. The filaments having a water content of not over 30%, are subjected to a dye bath, and drawn while immersed in the bath at least 1.5× and are then washed to rinse them and to extract spinning solvent.

4 Claims, 2 Drawing Figures

PROCESS FOR DYEING FILAMENTS OF ACRYLIC POLYMER

FIELD OF THE INVENTION

This invention relates to a process for dyeing dry-spun filaments of acrylonitrile polymer during their manufacture. More particularly, the invention is directed to a process for dyeing such filaments to deep shades by regulating the treatment applied to the filaments after they have been spum and before they are packed for shipment.

BACKGROUND OF THE INVENTION

Acrylonitrile polymer is manufactured by the producer in the form of filaments and converted to staple fibers by the producer or by his customer in the trade. Fibers and filaments of acrylonitrile polymer, i.e., acrylic fibers, are relatively difficult to dye. Although the producer usually adapts the acrylic fiber for improved dyeability by incorporation of copolymeric dye sites and other techniques, the dyeing step is usually carried out in the trade by using carefully controlled conditions and lengthy dyeing times.

The economic and technical advantage of dyeing as-spun acrylic filaments in the process of their manufacture is apparent, and methods to accomplish this have been developed for the wet-spinning process of producing acrylic filaments. These methods are described in, e.g., Cresswell U.S. Pat. No. 2,558,735, Moore U.S. Pat. No. 3,113,827, Wirth et al. U.S. Pat. No. 3,111,357, Briar et al. U.S. Pat. No. 3,296,341, and Japanese Pat. No. 44-24495 (1969). However, because of the inherent differences between wet- and dry-spinning procedures, the techniques that have been developed for dyeing wet-spun acrylic filaments are not easily adaptable for use with dry-spun acrylic filaments. For example, wet-spinning dyeing procedures generally require the formation of a gel of the filament which, of course, is not feasible in a dry-spinning operation. Consequently, methods have been sought to dye dry-spun acrylic filaments on the run during the production of the filaments. This has been termed the "producer dyeing" of filaments.

In the manufacture of producer colored acrylic filaments, it is desired in actual commercial practice to introduce the dye into the fiber at some stage after the spinning step. Otherwise, to make a desired change in the product color would necessitate interrupting the spinning process and flushing of the color from the system during the transition from one color to another. The acrylic filaments are therefore usually collected at the spinning step, and prior to the next step the spun filaments are usually stored for several hours or more.

In accordance with the present invention, it has been found that it is essential to maintain the dry-spun acrylic filaments at a relatively low level of water content after they have been spun but prior to the application of dye to the spun filaments. More specifically, it has been found that the water content of the spun filaments should not exceed 30%. It has also been found that it is critical to draw the filaments while they are still in contact with the liquid dye mixture. If the filaments become soaked with water before they are dyed, or if they are not drawn while still in contact with the liquid dye mixture, only a relatively low level of dye is absorbed into the fiber.

SUMMARY OF THE INVENTION

Thus, this invention is a process for dyeing filaments of dry-spun acrylic polymer which comprises, in sequence, the steps of 1. dry-spinning of acrylonitrile polymer,
2. collecting the spun filaments,
3. contacting the filaments with liquid dye by subjecting them to a liquid dye bath,
4. drawing the filaments at least 1.5× while they are still immersed in the liquid dye bath, and
5. immersing the filaments in a hot aqueous bath to rinse the filaments and extract spinning solvent from them;

said spun filaments having, just prior to step (3), a water content of not over 30% by weight.

Preferably, the filaments are drawn again after they have been drawn while immersed in the dye bath. It is also desirable that the rinsing of the dyed, drawn filaments be delayed for at least 2 seconds after the drawing step; preferably, 10 seconds or more. By this slight delay in the rinsing step, the degree of fixation of the dye in the filaments is increased.

DESCRIPTION OF THE INVENTION

Figure 1:
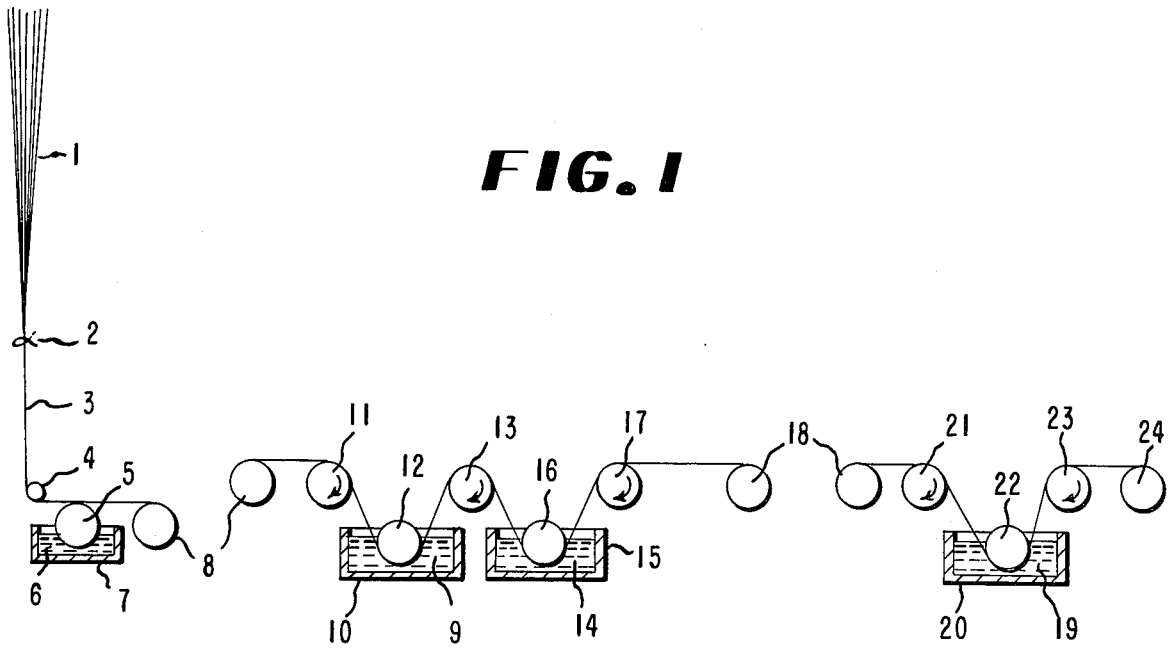
FIG. 1 is a schematic drawing of the various apparatus used in the process of this invention.

The filaments of acrylonitrile polymer employed in this invention are dry-spun filaments, manufactured in the conventional manner by spinning a heated solution of acrylonitrile polymer in a solvent for the polymer, such as dimethylformamide, dimethylacetamide, or dimethylsulfoxide. The solution is heated and extruded from spinnerets into a hot inert gas, where most of the spinning solvent is vaporized and removed. The filaments so spun normally contain from about 10 to 50% of the spinning solvent, based on the weight of the filaments. Upon leaving the spinning cell, the filaments are collected into bundles which may also be called ropes or tows. After the filaments are spun, they are moistened, e.g., by passing them in contact with a rotating roll which is partially immersed in a bath of water or aqueous finish. In the prior art it is known to apply an amount of water to the spun filaments which may even exceed the dry weight of the filaments; however, in accordance with the present invention, the amount of water applied to the spun filaments should not exceed 30% by weight. Typically, the spun filaments are collected by piddling them into an appropriate can or other container, or by winding them on a bobbin. The interval of time between collection of the spun filaments and the next step in their processing may vary from several hours to several days or even longer.

In accordance with the process of the present invention, the collected spun filaments are then immersed in a liquid dye bath. Preferably, the initial contact of dye on the filaments should be made nearly zero stretch. This zero stretch is only momentary, for the filaments are then drawn in the dye bath. It is critical that the filaments be stretched more than 1.5× while still in the dye bath, and preferably, the filaments are drawn at least 2×.

Finally, following the drawing step, the filaments are preferably permitted to remain wet with dye for a short time in order to set the dye. A time of about 2 seconds is sufficient for at least light shades. To ensure medium shades, 10 seconds can be used, while for deep shades, a lapse of 100 seconds or more may be used. After the dye is set, any excess dye may be rinsed off; and the dye filaments may also be drawn once more to enhance their physical properties. This second draw step is an optional one which depends on the properties desired and on the amount of draw in the first draw step. The second draw step may be carried out in such a way as to serve also as the extraction step, employing water at 90°–100° C. The rinse can be either a bath or a spray in which the filaments are contacted with the rinse medium to remove excess dye solution.

To aid in understanding the invention, reference is made to FIG. 1 in which filaments 1 of acrylonitrile polymer are spun and collected together by a guide 2 to form filament bundle 3. The filament bundle is then continuously passed under forwarding roll 4 and then over wetted roll 5, which is rotating in a bath of water 6 in container 7. From wetted roll 5 the filaments are wound up on bobbin 8. The spun filaments are then stored, in such a manner that the moisture content of the filaments remains substantially constant, until is is desired to subject them to further processing. In the second stage of the process, the filaments are withdrawn from bobbin 8 and passed into and through dye bath 9 in tank 10 by passing them over driven feed roll 11, under idler roll 12, and over driven roll 13. From roll 13 the filament bundle is passed through dye bath 14 in tank 15 by passing under idler roll 16 immersed in the dye bath and then to driven roll 17, finally being wound up on bobbin 18. The filament bundle is drawn at least 1.5×, preferably 2×, as it passes through the second dye bath 14, however, the bundle is preferably not drawn in the first dye bath 9. In the final stage of treatment, the filaments are withdrawn from bobbin 18 and passed through aqueous bath 19 in tank 20, by passing the filaments over driven roll 21, under idler roll 22, over driven roll 23, and finally winding up the filament bundle on bobbin 24. In aqueous bath 19, which is preferably maintained at a temperature of 90°–100° C., spinning solvent remaining in the filament is removed, together with any traces of dye remaining on the filaments which are not absorbed in the filaments. The filaments are preferably also given an additional draw as they pass through bath 19.

It will be appreciated that variations may be made in the above process without departing from the scope of the invention. For instance, the filament bundles may be piddled into collection cans rather than being wound upon bobbins. The initial drawing step may be carried out in the first dye bath 9 by imposing the draw between driven roll 13 and idler roll 12, with the filaments entering the tank under substantially zero stretch and the draw taking place after the filaments contact the idler roll. In this variation the second bath may be omitted. Also the number of tanks in the apparatus can be increased, and the final stage of rinsing with optional additional drawing may be combined with the stage of dyeing and drawing the filament bundle.

Figure 2:
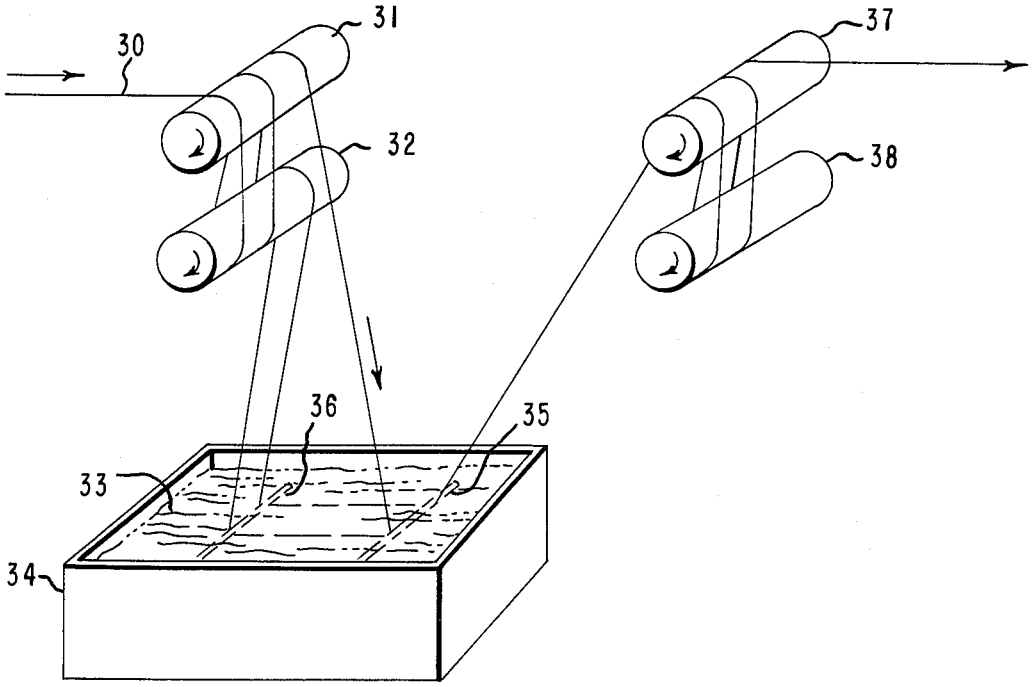
FIG. 2 is a schematic drawing of an alternative apparatus which may be used in the steps of application of the dye to the filaments and subsequent drawing of the filaments in contact with the liquid dye mixture.

An alternative apparatus which may be employed in the second stage of the process depicted in FIG. 1 is illustrated in FIG. 2. In this apparatus, a bundle 30 of dry-spun filaments of acrylonitrile polymer is withdrawn from a bobbin or other source (not shown) to a set of driven rolls 31 and 32, around which several wraps of the bundle are taken. Two passes of the bundle through bath 33 in tank 34 are then taken by passing the bundle under guide 35 at the far end of the tank, under guide 36 at the near end of the tank, over lower driven roll 32 and thence back under guides 36 and 35, the bundle finally being withdrawn from the tank by another pair of driven rolls 37 and 38. Rolls 37 and 38 are operated at a speed sufficiently higher than rolls 31 and 32 to impose the desired draw ratio upon the filament bundle. Upon leaving rolls 37 and 38 the filament bundle is wound upon a bobbin, not shown, after which it is ready for rinsing in a hot aqueous bath and optional drawing as shown in the last stage of FIG. 1.

The bundle of filaments may be a rope of acrylonitrile polymer filaments containing on the order of a few hundred filaments or more, or a tow formed by combining several such ropes and containing up to 500,000 to 1,000,000 filaments or even more.

The acrylonitrile polymers used to make the filaments employed in this invention are defined as long chain synthetic polymers composed of acrylonitrile units of the formula $$(-CH_2-\underset{\underset{CN}{|}}{CH}-)$$

in the polymer chain. As is well understood, the term includes the homopolymer of acrylonitrile (i.e., polyacrylonitrile) and copolymers of acrylonitrile and one or more suitable monoethylenically unsaturated monomers copolymerizable with acrylonitrile. Among the typical addition monomers exemplary of those which are copolymerizable with polyacrylonitrile are methyl acrylate, methyl methylacrylate, vinyl acetate styrene, methacrylamide, methacrylonitrile, vinyl chloride, vinyl bromide, vinylidene chloride, methyl vinyl ketone and the like as well as any of the available vinyl pyridines. The preferred comonomers include methyl acrylate, vinyl acetate, vinyl chloride, styrene and the vinyl pyridines. Sulfonate comonomers can also be employed, e.g., the sulfonated styrenes, vinyl sulfonate, allyl sulfonate, methallyl sulfonate and their alkali-metal or alkaline-earth-metal salts, and the like; it being necessary only that the compound chosen from this class be copolymerizable with acrylonitrile to the desired extent. The preferred sulfonate comonomers are the sulfonated styrenes.

The dyes useful in dyeing the filaments of acrylonitrile polymer must be soluble in a suitable solvent therefor, or at least dispersible in the solvent. Dyes having a particle size of not more than 100A are readily imbibed in an acrylonitrile polymer filament. The term "liquid dye bath" is limited to baths of those classes of mixtures. A suitable solvent for many dyes is a mixture of glycollic acid and water. The dyes may be selected from any of a wide number of dyestuff classes, preferably the dye chosen for the use is substantive to the acrylonitrile polymer substrate of the particular filaments which are being spun and drawn. Thus, basic dyes are particularly suited for use with acrylic fibers containing anionic sites; and acid dyes are suited for use with acrylic fibers containing basic sites. Many disperse dyestuffs are useful for acrylic fibers containing either acid or basic dye sites, as well as for filaments composed of acrylonitrile polymers containing neutral comonomers. The term dyes is intended to comprehend not only colored dyestuffs, but also optical brighteners and other materials which modify the visual appearance of luster of the filaments. Concentration of dye in the dye bath may range from about 0.1 to about 12% by weight, depending on the amount of dye on fiber desired.

The invention will be further illustrated by the following examples; however, the invention is not intended to be limited thereby. All percents are by weight unless otherwise specified. In the example, the determination of water is made with the use of the well-known Karl Fisher reagent. In this determination, a sample of the filaments is taken and weighed, after which it is placed in an empty flask and titrated with Karl Fisher reagent, the end point being revealed by the appearance of color resulting from excess of the reagent. The calculation is made in the usual way, the results being expressed as percentage of water based on the weight of the sample.

EXAMPLE I

Acrylonitrile polymer filaments are prepared by dry spinning a dimethylformamide solution of a terpolymer containing about 93.9% acrylonitrile, 6% methyl acrylate, and 0.1% sodium styrenesulfonate. The filaments, which contain about 18% dimethylformamide, are collected in the form of a bundle having an as-spun denier of about 1800, comprised of individual filaments having an as-spun denier of about 13. At the exit of the spinning cell, the filaments contact a rotating roll bearing a thin film of water, after which the spun filaments are wound up on a bobbin. The as-spun filaments contain less than 5% water by analysis. Immediately after spinning, the bobbin of spun filaments is placed in a polyethylene bag and the bag is closed.

After standing 16 hours in the closed polyethylene bag at the stated moisture level of less than 5% water, the filaments are passed from the bobbin over a rotating roll immersed in water and collected upon another bobbin. During the run a series of samples is prepared in which a different rate of rotation of the roll is used for each sample to vary the moisture level of the filaments passed over the roll, the filaments moistened at each speed of roll rotation being collected separately on different bobbins. The moisture level of the collected filaments is determined, and the filament samples are stored in separate closed polyethylene bags for 24 hours, each sample remaining in equilibrium with water at the applied level during the storage period. One additional sample is stored in a polyethylene bag filled with water to provide a soaked filament sample.

In a series of runs, each sample of the stored filaments is passed through a tank of a 2% aqueous solution of the dye having the Color Index identification of Basic Blue 3, using the apparatus shown in FIG. 2. The temperature of the bath is 65° C. After passing through the bath once as shown in the figure, the filament bundle is passed over the lower of the two driven rolls from which it entered the bath and is then passed back through the dye bath again in the reverse direction. A draw ratio of 2.5× is imposed in the bundle as it passes through the dye bath the second time by means of a third set of driven rolls around which the bundle of filaments is passed after leaving the dye bath. Upon leaving the third set of driven rolls, the bundle of filaments is taken up on a bobbin. Finally, the dyed filaments are passed from the bobbin through a tank of boiling water wherein they are drawn an additional 2×, after which the filaments are wound up once more. In addition to the stretching imposed in the final step, residual dimethylformamide and a small amount of unadsorbed dye is extracted from the filament in the boiling water.

The results obtained are shown in Table 1. As shown in the table, good results are obtained for dye on fiber from filaments containing up to about 30% water on the filament, and these filaments in each case are dyed to a deep shade of blue. However, filaments which are soaked with water prior to the dyeing step exhibit a much lower level of dye on fiber, and the filaments are observed visually to be dyed to a lighter shade of blue than the filaments maintained substantially dry prior to application of the dye.

Table 1

| Water Level on Fiber | Dye on Fiber |
|---|---|
| Soaked | 1.72% |
| 28% | 2.53 |
| 17 | 2.42 |
| 14 | 2.92 |
| 9 | 2.66 |
| Under 5 | 3.27 |

EXAMPLE II

As-spun filaments of a terpolymer containing about 94.5% acrylonitrile, 5.8% methyl acrylate, and 0.2% sodium styrenesulfonate, containing between 18 and 23% dimethylformamide in the fiber and less than 5% water on the fiber, are collected in the form of a bundle having an as-spun denier of about 8000, comprised of individual filaments having an as-spun denier of about 11.

In a series of runs, filaments are passed from a bobbin into a tank of a 2% aqueous solution of the dye having the Color Index identification of Basic Red 18, as described in FIG. 1. The filaments are drawn in the bath, with the draw taking place after the filaments pass under the idler roll. After the filaments are dyed and drawn, they are washed and drawn simultaneously in boiling water to total of 4.5× after an interval of 600 seconds. Different draw ratios are applied in the various runs. In a series of runs which are summarized in Table 2, the draw ratios employed in the stretching step are varied, as well as the temperature of the dye bath. As shown in the table, a draw ratio in excess of 1.5× is required to obtain a good fixation of the dye in the fiber.

Table 2

| Dye Bath Temperature | Draw Ratio | Dye on Fiber |
|---|---|---|
| 60°C. | 1.5X | 1.05% |
| | 1.8 | 2.38 |
| | 2.0 | 2.88 |
| 70°C. | 1.5 | 0.85 |
| | 1.8 | 1.30 |
| | 2.0 | 1.45 |
| | 2.5 | 2.55 |
| | 3.0 | 2.70 |

EXAMPLE III

As-spun filaments of a terpolymer containing about 94% acrylonitrile, 5.8% methyl acrylate, and 0.2% sodium styrenesulfonate, containing 18–34% dimethylformamide in the fiber and less than 5% water on the fiber, having a denier of about 8000 and are collected in the form of a rope containing about 700 individual filaments having an as-spun denier of about 11.4. The rope is fed at a speed of about 18 ypm into a tank containing a 2% aqueous solution of the dye having the Color Index identification of Basic Red 18. The filaments are drawn 2.2× in the tank, which is maintained at a temperature of 60° C., with the draw taking place after the filaments pass under the idler roll, as described in Example II. The filaments are then redrawn by passing them through a bath of boiling water while applying to them a draw ratio of 2.5×, the residual spinning solvent being extracted into the bath. The filaments are dyed to a deep shade of red and analyze for 3.05% dye on fiber. It is observed that essentially none of the dye comes off in the rinse-draw step.

EXAMPLE IV

As-spun filaments of a terpolymer containing about 94% acrylonitrile, 5.8% methyl acrylate, and 0.2% sodium styrenesulfonate, similar to the filaments of Example III and containing less than 5% water on the fiber, are collected in the form of a bundle. The filaments are then passed from a bobbin into a tank of 2% aqueous solution of the dye having the Color Index identification of Basic Red 18. The filaments are drawn 2.2× in the bath, with the draw taking place after the filaments pass under the idler roll, as described in Example II. After the filaments are dyed and drawn, they are rinsed by hand after being held for an interval after the dyeing/draw step. Table 3 shows the results of varying the interval before the rinse step in terms of the degree of fixation of dye on dye on fiber, based on the amount of dye removed from the bath.

Table 3

| Lag Between Dye Application and Rinse | % Dye Fixed |
|---|---|
| 10 seconds | 65% |
| 20 | 91 |
| 40 | 100 |

The experiment is repeated, using a dye bath consisting of a 1% aqueous solution of the dye having the Color Index identification of Basic Blue 3 in place of the dye bath described above. Using this dye bath, it is observed that a level of 89% dye fixation is obtained after an interval of only 3 seconds before the rinse step; while a 24-second interval yields a level of 93% dye fixation and a 64-second interval before the rinse step yields a level of 100% fixation.

EXAMPLE V

As-spun filaments of a terpolymer containing about 94% acrylonitrile, 5.8% methyl acrylate, and 0.2% sodium styrenesulfonate, containing 21% dimethylformamide in the fiber and less than 5% water on the fiber are collected in the form of a filament bundle.

In a series of runs, filaments are passed from a bobbin into a tank of aqueous dye solution maintained at 62° C., the filament bundle being drawn 2.2× in the tank, with the draw taking place after the filaments pass under the idler roll, as described in Example II. In a series of runs, solutions of different dyes at various concentrations are employed, as shown in Table 4. After an interval of seconds the filament bundles are further drawn 2.0× in boiling water. Color photographs are made of the cross sections of the dyed filaments, and examination of these photographs reveal that each color penetrated into the center of the filament even though the residence time in the dye bath while being stretched is only 0.01 seconds. By comparison, in conventional dyeing, the dye does not usually penetrate so thoroughly in less than 30 minutes.

Table 4

| Dye Identification (Color Index) | Dye Concentration In Bath | Dye On Fiber |
|---|---|---|
| Basic Blue 3 | 1.0% | 1.25 |
| | 3.0 | 2.8 |
| | 4.9 | 4.65 |
| Basic Yellow 13 | 2.0 | 2.05 |
| | 4.0 | 4.1 |
| Basic Red 18 | 2.0 | 2.2 |
| | 4.0 | 3.8 |

EXAMPLE VI

Bicomponent filaments are spun in the conventional manner, using on one side a terpolymer of 94% acrylonitrile, 5.8% methyl acrylate, and 0.2% sodium styrenesulfonate and on the other side of copolymer of 95% acrylonitrile and 5% sodium styrenesulfonate. The spun bicomponent filaments are collected in a bundle of 300 filaments having a denier of about 1000 and containing 22% DMF and less than 5% water on the fiber. The bundle of bicomponent filaments is fed at a speed of 10 ypm into a tank containing a 2.7% aqueous solution of the dye having the Color Index identification of Basic Red 18. The filaments are drawn 2.2× in the tank, which is maintained at a temperature of 60° C. The contact time in the tank is 1 second, with the draw in the filament bundle taking place after the filament bundle passes under the idler roll, as described in Example II. After the filaments are dyed and drawn, they are wound on a tube. After the filaments have been held on the tube 5–10 minutes, they are redrawn by passing them through a bath of boiling water while applying to them a draw ratio of 2.0×. The filaments are dyed to a deep shade of red and analyze for 5.3% dye on fiber. It is observed that essentially none of the dye comes off in the rinse-draw step. In a similar experiment using an 8% aqueous solution of the dye, the filaments are found to absorb 9.9% dye on fiber. Similar results are obtained with aqueous solutions of the basic dyes having the Color Index identification of Basic Yellow 13 and Basic Blue 3.

EXAMPLE VII

As-spun filaments of a terpolymer containing about 94% acrylonitrile, 5.8% methyl acrylate, and 0.2% sodium styrenesulfonate are prepared in two spinning runs in which the conditions, all within conventional range, yield filaments having different amounts of residual dimethylformamide in the fiber. In one sample the residual dimethylformamide content is 12%, and in the second sample the residual dimethylformamide content is 23%. In each case the filaments are collected in the form of bundles having a denier of about 8000 and containing about 700 individual filaments. The spun filaments contain less than 5% water on fiber in each instance.

In separate runs, the filaments are passed from a bobbin into a tank of a 2% aqueous solution of the dye having the Color Index identification of Basic Red 18, the dye bath being maintained at 60° C. The filaments are drawn 2.2× in the tank, with the draw taking place after the filaments pass under the idler roll, as described in Example II. The percentage dye on fiber is found to be 2.8% for the first sample and 2.9% for the second sample. Thus, despite the differing levels of dimethylformamide in the filaments, the absorption of dye on fiber is practically the same.

The foregoing detailed description has been given for clearness of understanding only and no unnecessary limitations are to be understood therefrom. The invention is not limited to the exact details shown and described for obvious modifications will occur to those skilled in the art.

The embodiments of the invention in which an exclusive property or privilege is claimed are defined as follows:

1. A process for dyeing filaments of dry-spun acrylic polymer which comprises, in sequence, the steps of 1. dry-spinning a solution of acrylonitrile polymer to form undrawn filaments containing from about 10 to 50 percent by weight of spinning solvent,
2. moistening the spun filaments to have a water content of not over 30 percent by weight,
3. contacting the moist, solvent-containing, undrawn filaments with liquid dye by immersing them in a liquid dye bath,
4. drawing the filaments at least 1.5× while they are still immersed in the dye bath, and
5. immersing the filaments in a hot aqueous bath to rinse the filaments and extract spinning solvent from them.

2. The process of claim 1 wherein the filaments are drawn again in step (5).

3. The process of claim 1 wherein the filaments are delayed for at least 2 seconds between steps (4) and (5).

4. The process of claim 1 wherein the polymer is composed of about 93.9% acrylonitrile, 6% methyl acrylate and 0.1% sodium styrenesulfonate.

* * * * *